US007204434B2

(12) United States Patent
Pasquali et al.

(10) Patent No.: US 7,204,434 B2
(45) Date of Patent: Apr. 17, 2007

(54) FUEL INJECTOR

(75) Inventors: Paolo Pasquali, Castelmaggiore (IT); Luigi Gagliardi, Bologna (IT); Marcello Cristiani, Imola (IT)

(73) Assignee: Magneti Marelli Powertrain S.p.A., Corbetta (IT)

( * ) Notice: Subject to any disclaimer, the term of this patent is extended or adjusted under 35 U.S.C. 154(b) by 0 days.

(21) Appl. No.: 11/454,767

(22) Filed: Jun. 16, 2006

(65) Prior Publication Data

US 2007/0001033 A1 Jan. 4, 2007

(30) Foreign Application Priority Data

Jun. 17, 2005 (EP) ..... 05425435

(51) Int. Cl.
*F02M 51/00* (2006.01)

(52) U.S. Cl. ..... 239/585.4; 239/456

(58) Field of Classification Search ..... 239/585.1, 239/585.4, 585.5, 456, 459
See application file for complete search history.

(56) References Cited

U.S. PATENT DOCUMENTS

| | | | | |
|---|---|---|---|---|
| 4,917,352 | A * | 4/1990 | Hauet et al. | 251/129.19 |
| 5,551,634 | A | 9/1996 | Raab et al. | |
| 6,170,767 | B1 * | 1/2001 | Herold et al. | 239/585.3 |
| 6,367,769 | B1 * | 4/2002 | Reiter | 251/129.19 |
| 6,431,472 | B1 * | 8/2002 | Tian et al. | 239/585.1 |
| 6,435,429 | B1 | 8/2002 | Eichendorf et al. | |
| 6,732,949 | B1 | 5/2004 | Harn Dorf | |
| 2002/0079388 | A1 | 6/2002 | Tian et al. | |

FOREIGN PATENT DOCUMENTS

| | | |
|---|---|---|
| DE | 19849956 | 4/2000 |
| EP | 1041272 | 10/2000 |
| GB | 2349421 | 11/2000 |

OTHER PUBLICATIONS

International Search Report dated Dec. 5, 2005 from EP 05425435.4.

* cited by examiner

*Primary Examiner*—Christopher Kim
(74) *Attorney, Agent, or Firm*—Ohlandt, Greeley, Ruggiero & Perle, L.L.P.

(57) ABSTRACT

A fuel injector has an injection valve having a movable pin terminating with a shutter head; a tubular supporting body having a feed channel; and a sealing body, in which a valve seat of the injection valve is defined; the shutter head is truncated-cone-shaped, is located outside the sealing body, and, in a closed position, is pushed against the sealing body in the opposite direction to the fuel feed direction; the pin has a stop member, which is integral with the pin and comes to rest on a top surface of the sealing body, when the pin is in the open position opening the injection valve, so as to determine travel of the pin.

21 Claims, 4 Drawing Sheets

FUEL INJECTOR

The present invention relates to a fuel injector.

The present invention may be used to advantage in an electromagnetic injector, to which the following description refers purely by way of example.

BACKGROUND OF THE INVENTION

An electromagnetic fuel injector comprises a cylindrical tubular housing body having a central feed channel, which acts as a fuel conduit and terminates with an injection nozzle regulated by an injection valve controlled by an electromagnetic actuator. The injection valve has a pin, which is connected rigidly to a movable armature of the electromagnetic actuator, and is moved by the electromagnetic actuator between a closed position and an open position, respectively closing and opening the injection nozzle, in opposition to a spring which keeps the pin in the closed position. The pin terminates with a shutter head, which, in the closed position, is pushed by the spring against a valve seat of the injection valve to prevent fuel outflow. The shutter head is normally housed inside the fuel conduit, and, to move from the closed to the open position of the injection valve, therefore moves in the opposite direction to the fuel feed direction.

Electromagnetic fuel injectors of the above type are cheap and easy to produce and have a good cost-performance ratio. On the other hand, they fail to provide for precision and stability in the fuel injection direction, and are therefore unsuitable for so-called "spray-guided" engines, in which fuel must be injected precisely close to the spark plug. In this type of application, in fact, an error of less than a millimeter in the fuel flow direction may wet the spark plug electrodes and so seriously impair combustion.

To achieve a highly precise, highly stable fuel injection direction, an electromagnetic fuel injector has been proposed, in which the shutter head is truncated-cone-shaped, is located outside the fuel conduit, is pushed by a spring against the valve seat of the injection valve in the opposite direction to the fuel feed direction, and so moves from the closed to the open position in the same direction as the fuel feed direction.

In injectors in which the pin moves into the open position in the same direction as the fuel feed direction, however, the effect of the difference in thermal expansion of the pin and the housing body has been found to be less than negligible. In actual use, the housing body is in direct contact with the cylinder head of the engine, and so reaches an operating temperature of 120–140° C., whereas the pin, being immersed in the fuel flow, reaches operating temperatures of 60–70° C. The difference in operating temperature results in a corresponding difference in the thermal expansion of the pin and the housing body, which, when significant, alters the size of the fuel passage, with obvious effects on fuel injection flow. In fact, for a given injection pressure, the larger the fuel passage, the greater the fuel injection flow. In other words, injectors in which the pin moves into the open position in the same direction as the fuel feed direction fail to ensure highly precise, highly stable fuel injection flow (and, hence, the amount of fuel injected at each injection) on account of the difference in thermal expansion of the pin and the housing body.

To reduce the negative effect of the difference in thermal expansion of the pin and the housing body, it has been proposed to make the pin and the housing body from steel with a low thermal expansion coefficient (typically, INVAR). Using steel with a low thermal expansion coefficient, however, not only fails to solve the problem completely, but also increases the cost of the injector.

To compensate the difference in thermal expansion of the pin and the housing body, it has also been proposed to connect the pin actuator to a hydraulic compensating device for maintaining a constant distance between the pin armature and the valve seat. Using a hydraulic compensating device, however, makes the injector more complicated and more expensive to produce.

US2002079388 discloses a nozzle assembly for fuel injection in an internal combustion engine and comprising a nozzle tip with a hollow interior defining a fuel chamber. The nozzle tip has at least one spray orifice opening to an outer surface on the nozzle tip, and a valve member at least partially disposed within the nozzle tip; the valve member is moveable between a first position in which the valve member contacts an upper valve seat to prevent fluid communication of fuel from the fuel chamber to the at least one spray orifice, and a second outward position in which the valve member contacts a lower valve seat to allow fluid communication of fuel from the fuel chamber to the at least one spray orifice. The valve member is directly electrically actuated, preferably by a solenoid; further, the valve member is biased in the closed position and the valve member is pressure balanced when high pressure fuel in present in the fuel chamber.

GB2349421 discloses a register nozzle having two through-flow cross-sections for the purpose of injecting fuel, in particular heavy oil, in two stages from a pressure chamber into the combustion chamber of an internal combustion engine. The register nozzle has a nozzle holder and a nozzle body in which a nozzle needle which is pretensioned by virtue of a spring can be displaced in an axial manner by means of a nozzle needle stroke stop device; a sleeve is received in an axially displaceable manner on the nozzle needle in the nozzle body and, when acted upon by pressure, is moved against a sleeve stop, which is formed on the nozzle body, the nozzle needle stroke stop device moving into position against said sleeve in the first injection stage, and a stop being formed on the nozzle body, the nozzle needle stroke stop device moving into position against said stop in the second injection stage.

SUMMARY OF THE INVENTION

It is an object of the present invention to provide a fuel injector with an electromagnetic actuator, designed to eliminate the aforementioned drawbacks, and which, in particular, is cheap and easy to produce.

According to the present invention, there is provided a fuel injector with an electromagnetic actuator, as claimed in the attached claims.

DETAILED DESCRIPTION OF THE INVENTION

A number of non-limiting embodiments of the present invention will be described by way of example with reference to the accompanying drawings, in which.

BEST MODE FOR CARRYING OUT THE INVENTION

Figure 1:
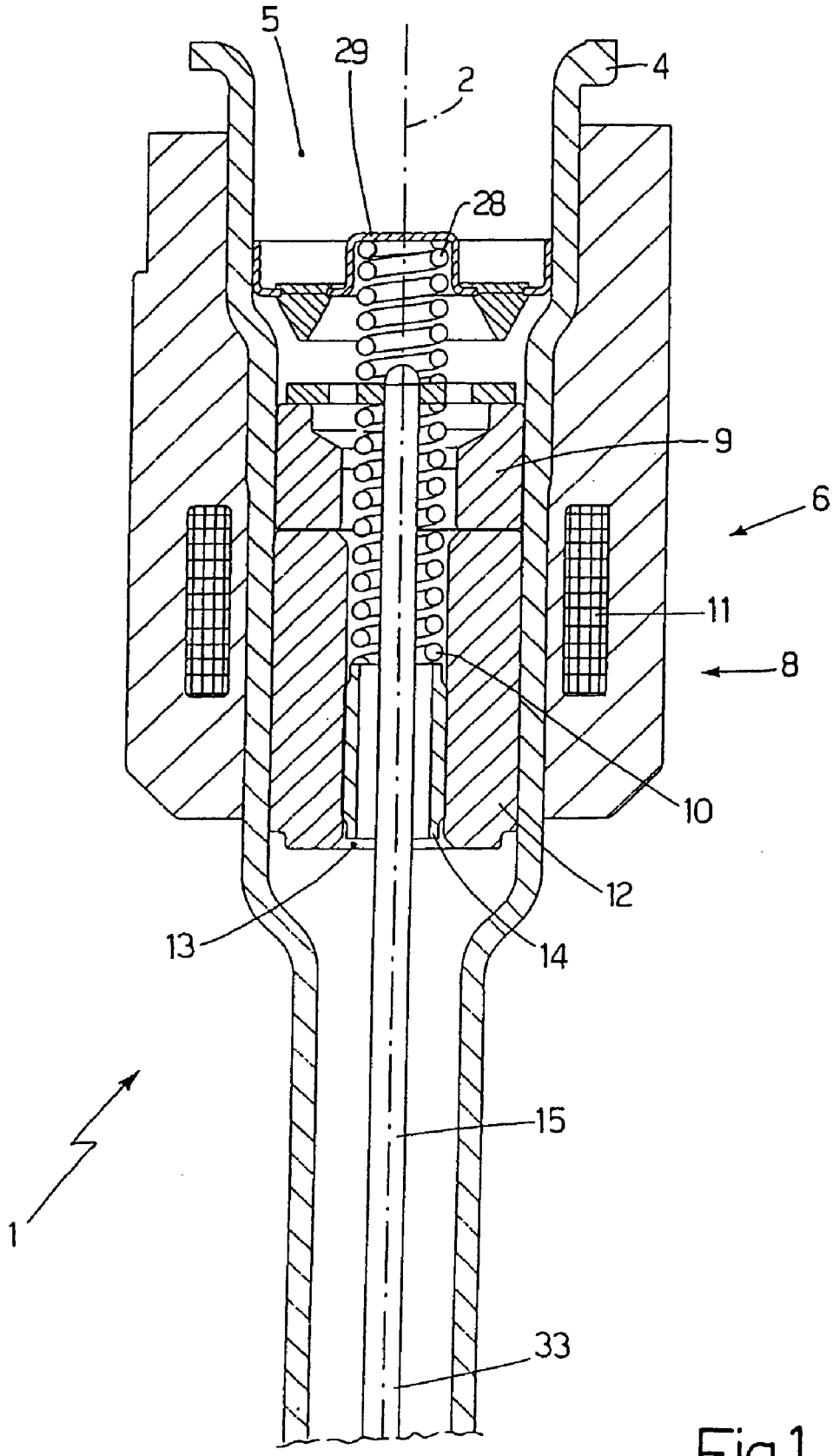
FIG. 1 shows a schematic lateral section, with parts removed for clarity, of a fuel injector in accordance with the present invention.
Figure 2:
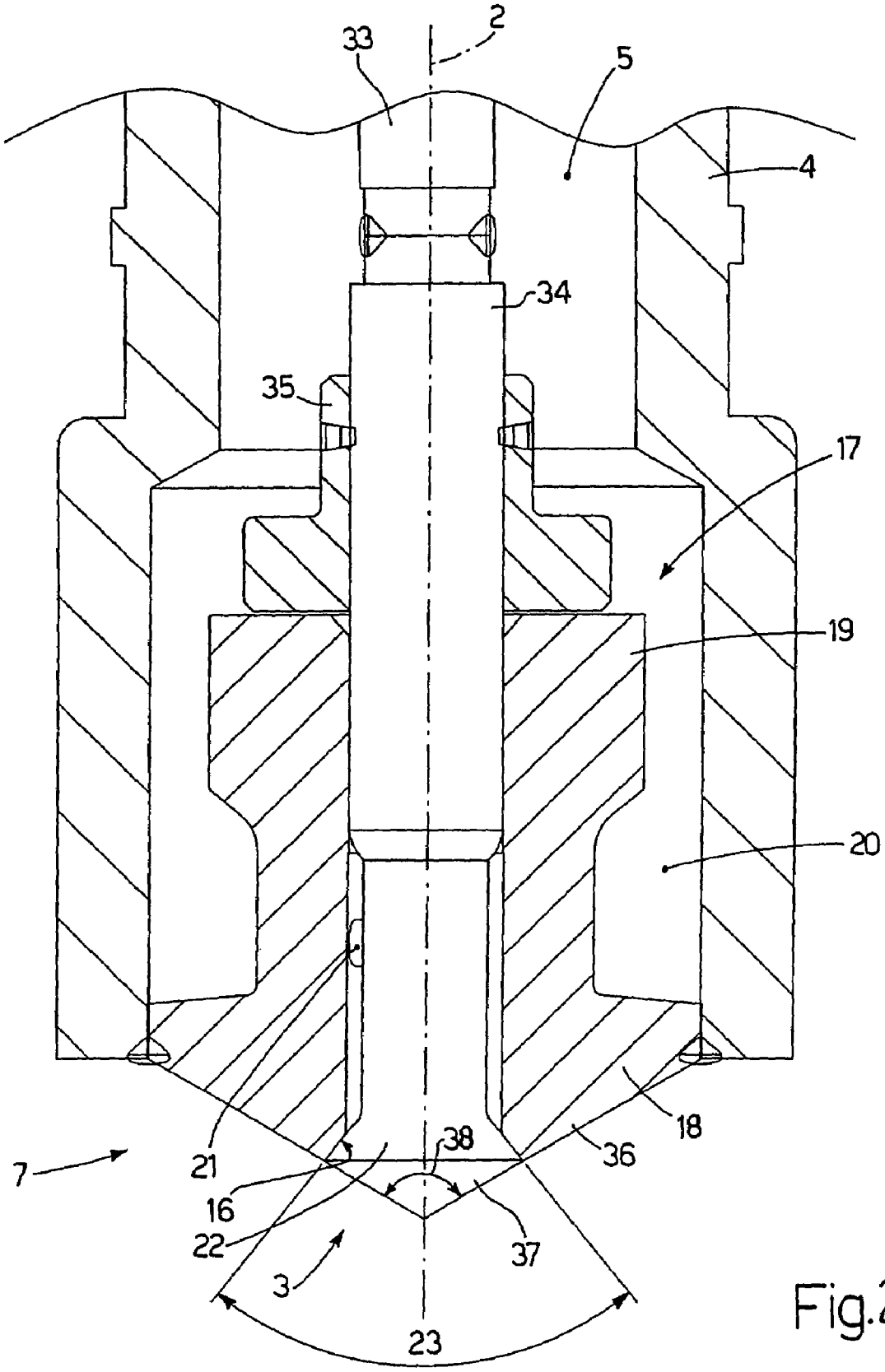
FIG. 2 shows a larger-scale view of an injection valve of the FIG. 1 injector.

Number 1 in FIG. 1 indicates as a whole a fuel injector, which is substantially cylindrically symmetrical about a longitudinal axis 2, and is controlled to inject fuel from an injection nozzle 3 (FIG. 2) which comes out directly inside a combustion chamber (not shown) of a cylinder. Injector 1 comprises a one-piece, cylindrical tubular supporting body 4 varying in cross section along longitudinal axis 2, and having a feed channel 5 extending along the whole of its length to feed pressurized fuel to injection nozzle 3. Supporting body 4 has a top portion housing an electromagnetic actuator 6, and a bottom portion housing an injection valve 7 (FIG. 2). In actual use, injection valve 7 is activated by electromagnetic actuator 6 to regulate fuel flow through injection nozzle 3, which is formed at injection valve 7.

Electromagnetic actuator 6 comprises an electromagnet 8 housed in a fixed position inside supporting body 4, and which, when energized, moves a movable armature 9 of ferromagnetic material along axis 2, from a closed position closing injection valve 7 to an open position opening injection valve 7, in opposition to a main spring 10 which maintains movable armature 9 in the closed position closing injection valve 7. More specifically, electromagnet 8 comprises a coil 11 powered electrically by an electronic control unit (not shown) and located outside supporting body 4; and a fixed magnetic armature 12 housed inside supporting body 4 and having a central hole 13 for fuel flow to injection nozzle 3. A cylindrical tubular retaining body 14 (possibly open along a generating line) is inserted in a fixed position inside central hole 13 of fixed magnetic armature 12 to permit fuel flow to injection nozzle 3 and to compress main spring 10 against movable armature 9.

Movable armature 9 forms part of a movable assembly, which also comprises a shutter or pin 15 having a top portion integral with movable armature 9, and a bottom portion which cooperates with a valve seat 16 (FIG. 2) of injection valve 7 to regulate fuel flow through injection nozzle 3 in known manner.

As shown in FIG. 2, valve seat 16 is truncated-cone-shaped and defined in a one-piece sealing body 17 comprising a disk-shaped plugging member 18, which seals the bottom of feed channel 5 of supporting body 4, and through which injection nozzle 3 extends. A tubular guide member 19 extends upwards from plugging member 18, houses pin 15 to define a bottom guide of pin 15, and has an outside diameter smaller than the inside diameter of feed channel 5 of supporting body 4, so as to define an outer annular channel 20 along which pressurized fuel flows.

In an alternative embodiment not shown, the top of guide member 19 is the same diameter as the inside diameter of feed channel 5 of supporting body 4; and, to feed fuel into annular channel 20, openings (typically two or four arranged symmetrically) are milled in the top of guide member 19.

Four through holes 21 (only one shown in FIG. 2) are formed in the bottom of guide member 19, and come out towards valve seat 16 to permit pressurized-fuel flow to valve seat 16. Through holes 21 are preferably offset with respect to longitudinal axis 2, so as not to converge towards longitudinal axis 2, and so as to produce swirl of the respective fuel streams in use. Alternatively, through holes 21 may converge towards longitudinal axis 2. In FIG. 2, holes 21 form a 90° angle with longitudinal axis 2. In an alternative embodiment not shown, holes 21 are inclined and form an angle of substantially 60° to 80° with longitudinal axis 2.

Pin 15 terminates with a truncated-cone-shaped shutter head 22, which rests hermetically on valve seat 16, which is also truncated-cone-shaped to negatively reproduce the truncated-cone shape of shutter head 22. It is important to note that shutter head 22 is located outside guide member 19, and is pushed against guide member 19 by main spring 10, so that, to move from the closed position closing injection valve 7 to the open position opening injection valve 7, shutter head 22 moves downwards along longitudinal axis 2, i.e. in the same direction as the fuel feed direction.

In the open position opening injection valve 7, shutter head 22 is detached from valve seat 16 to form an annular-section, truncated-cone-shaped fuel flow opening, so that the fuel injected through injection nozzle 3 issues in the form of a hollow cone with a flare angle substantially identical to the flare angle 23 of shutter head 22 (corresponding exactly to the flare angle of valve seat 16).

Figure 3:
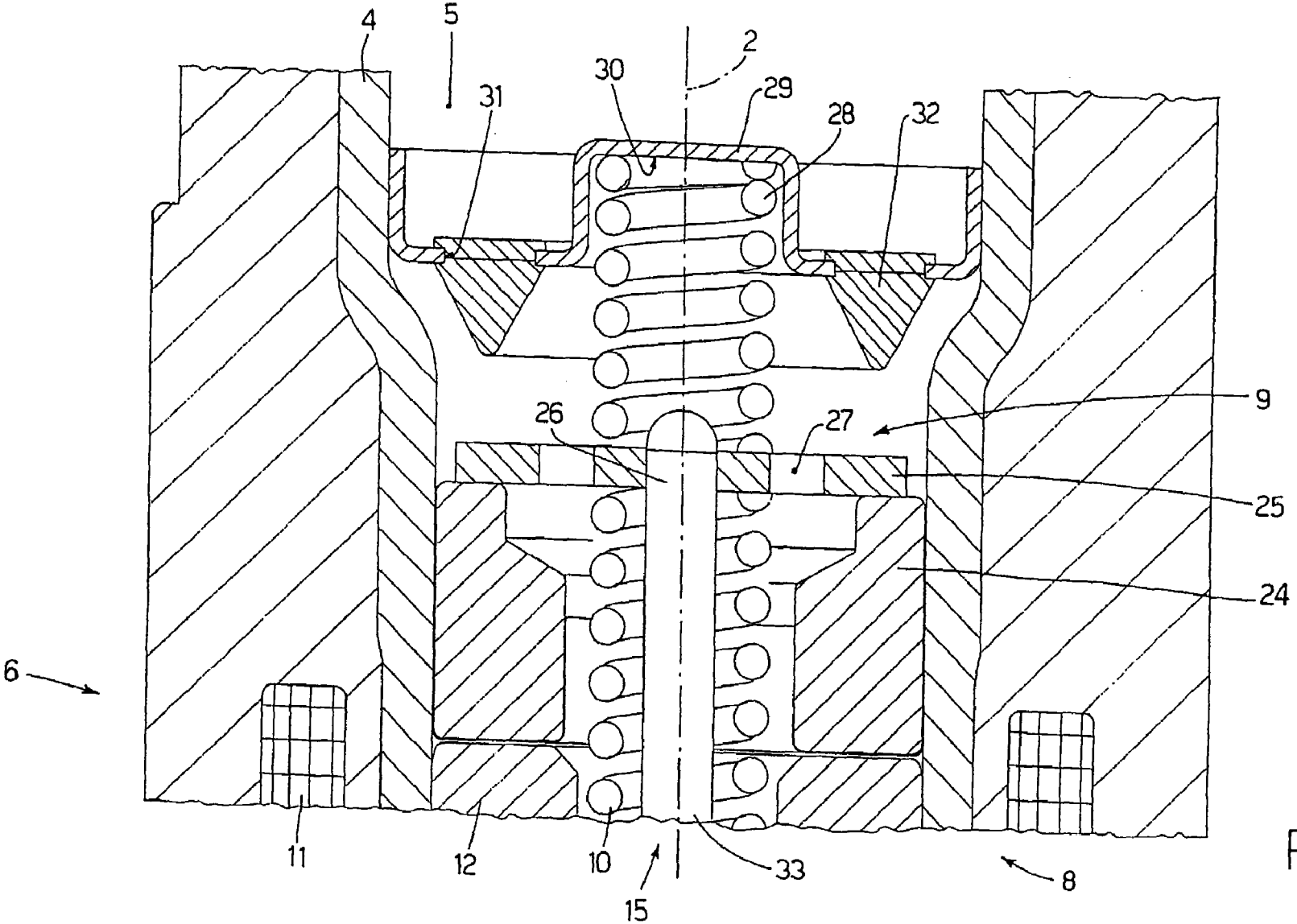
FIG. 3 shows a larger-scale view of an armature of an electromagnetic actuator of the FIG. 1 injector.

As shown in FIG. 3, movable armature 9 comprises an annular member 24; and a disk-shaped member 25, which closes the top of annular member 24, and in turn comprises a central through hole 26 for receiving a top portion of pin 15, and a number of peripheral through holes 27 (only two shown in FIG. 3) to permit fuel flow to injection nozzle 3. A central portion of disk-shaped member 25 is contoured to house and hold a top end of main spring 10 in position. Pin 15 is preferably made integral with disk-shaped member 25 of movable armature 9 by an annular weld.

Annular member 24 of movable armature 9 has an outside diameter substantially equal to the inside diameter of the corresponding portion of feed channel 5 of supporting body 4, so that movable armature 9 can slide with respect to supporting body 4 along longitudinal axis 2, but is prevented from moving crosswise to longitudinal axis 2 with respect to supporting body 4. Pin 15 being connected rigidly to movable armature 9, movable armature 9 obviously also acts as a top guide for pin 15, which is therefore guided at the top by movable armature 9 and at the bottom by guide member 19.

A calibrating spring 28 is also provided, and is compressed between movable armature 9 and a retaining body 29 inserted in a fixed position inside supporting body 4. More specifically, calibrating spring 28 has a top end resting on an underside wall of retaining body 29; and a bottom end resting on a topside wall of disk-shaped member 25 of movable armature 9, on the opposite side to main spring 10. Calibrating spring 28 exerts elastic force on movable armature 9 in the opposite direction to the elastic force of main spring 10. When assembling injector 1, the position of retaining body 29 is adjusted to adjust the elastic force produced by calibrating spring 28, and so calibrate the total elastic thrust exerted on movable armature 9.

In a preferred embodiment shown in FIG. 3, retaining body 29 is circular, and comprises a central portion, in which a seat 30 for housing calibrating spring 28 is defined; and a peripheral portion, in which a number of through holes 31 (only two shown in FIG. 3) are formed to permit fuel flow to injection nozzle 3. Each through hole 31 is preferably provided with a filtering element 32 for retaining any residue or impurities in the fuel.

As shown in FIGS. 1 and 2, pin 15 comprises a top portion 33 integral with movable armature 9, and a bottom portion 34 supporting shutter head 22; and the two portions 33, 34 of pin 15 are welded to each other. This solution reduces machining cost, by only bottom portion 34 supporting shutter head 22 being precision-machined, and top portion 33 being machined less accurately.

As shown in FIG. 2, bottom portion 34 of pin 15 comprises a stop member 35 integral with pin 15, and which, when pin 15 is moved into the open position opening injection valve 7 by the thrust exerted on pin 15 by electromagnet 8, comes to rest on a top surface of guide member 19 to determine the travel of pin 15. The axial size (i.e. along longitudinal axis 2) of the air gap between movable armature 9 and fixed magnetic armature 12 is established beforehand, so that it is always greater than the travel of pin 15, to ensure travel is determined by stop member 35 contacting guide member 19, and not by movable armature 9 contacting fixed magnetic armature 12.

Given that movable armature 9 never comes into contact with fixed magnetic armature 12, the air gap between movable armature 9 and fixed magnetic armature 12 is therefore never eliminated. Obviously, when designing electromagnet 8, the effect of the air gap, which is larger than in a conventional electromagnetic injector, must be taken into account.

The fact that the travel of pin 15 is determined by arrest of stop member 35 provides for eliminating, or at least reducing to negligible marginal values, the negative effects on the travel of pin 15 of the difference in thermal expansion of pin 15 and supporting body 4. This is achieved by the travel of pin 15 being affected solely by the position of stop member 35 with respect to guide member 19, and so only varying as a result of any difference in thermal expansion of bottom portion 34 of pin 15 with respect to guide member 19. Since the total axial length of bottom portion 34 of pin 15 is small as compared with top portion 33 of pin 15, thermal expansion of bottom portion 34 of pin 15 is therefore also reduced. Moreover, bottom portion 34 of pin 15 is almost entirely in direct contact with guide member 19, which is soaked entirely with fuel, so that bottom portion 34 of pin 15 and guide member 19 are both substantially at the same temperature and so undergo the same thermal expansion.

As stated, sealing body 17 is formed in one piece, and comprises a disk-shaped plugging member 18, which seals the bottom of feed channel 5 of supporting body 4, and through which injection nozzle 3 extends; a bottom end portion 36, outside supporting body 4, of plugging member 18 is truncated-cone-shaped; a bottom end portion 37, outside supporting body 4, of shutter head 22 is conical, with its lateral surface sloping at an angle 38 equal to the slope angle of the lateral surface of bottom end portion 36 of plugging member 18, so that, when pin 15 is in the closed position, bottom end portion 37 of shutter head 22 forms a natural seamless continuation of bottom end portion 36 of plugging member 18; and the slope angle 38 of the lateral surfaces of bottom end portions 36 and 37 is complementary with the flare angle 23 of shutter head 22 (corresponding exactly to the flare angle of valve seat 16), i.e. the slope angle 38 of the lateral surfaces of bottom end portions 36 and 37 plus the flare angle 23 of shutter head 22 equals 180°, so that, when pin 15 is in the open position, fuel issues from injection nozzle 3 perpendicularly to the lateral surfaces of bottom end portions 36 and 37, and is detached excellently from the lateral surfaces of bottom end portions 36 and 37 to achieve a highly precise, consistent injection direction.

In actual use, when electromagnet 8 is deenergized, movable armature 9 is not attracted by fixed magnetic armature 12, and the elastic force of main spring 10 pushes movable armature 9, together with pin 15, upwards, so that shutter head 22 of pin 15 is pressed against valve seat 16 of injection valve 7 to prevent outflow of the fuel. When electromagnet 8 is energized, movable armature 9 is attracted magnetically by fixed magnetic armature 12 in opposition to the electric force of main spring 10, and is moved downwards, together with pin 15, until stop member 35 comes to rest on guide member 19; in which condition, movable armature 9 is separated from fixed magnetic armature 12, shutter head 22 of pin 15 is lowered with respect to valve seat 16 of injection valve 7, and pressurized fuel is allowed to flow through injection nozzle 3.

As stated, the four through holes 21 which come out towards valve seat 16 are preferably offset with respect to longitudinal axis 2, so as not to converge towards longitudinal axis 2, and so as to produce swirl in the respective fuel streams in use. Swirl of the fuel immediately upstream from valve seat 16 distributes the fuel homogeneously and evenly along the whole circumference to prevent the formation of "voids", i.e. areas containing less fuel.

When shutter head 22 of pin 15 is raised with respect to valve seat 16, fuel flows to the injection nozzle 3 first through outer annular channel 20 and then through the four through holes 21. In other words, when shutter head 22 of pin 15 is raised with respect to valve seat 16, the fuel flowing to the injection nozzle 3 soaks the whole outer lateral surface of guide member 19, which is thus cooled constantly by relatively cool fuel, and the cooling effect of guide member 19 is transmitted to the whole of sealing body 17 (which is one-piece) and therefore also to plugging member 18 in which injection nozzle 3 is formed. In other words, guide member 19, being soaked constantly inside and out with fuel, acts as a radiator to dissipate heat from the outside and inside plugging member 18.

Tests have shown that reducing the work temperature of plugging member 18 greatly reduces the formation of scale on the outer surface of plugging member 18 and therefore close to valve seat 16; and reducing the formation of scale close to valve seat 16 greatly increases the working life of injector 1 described.

Figure 4:
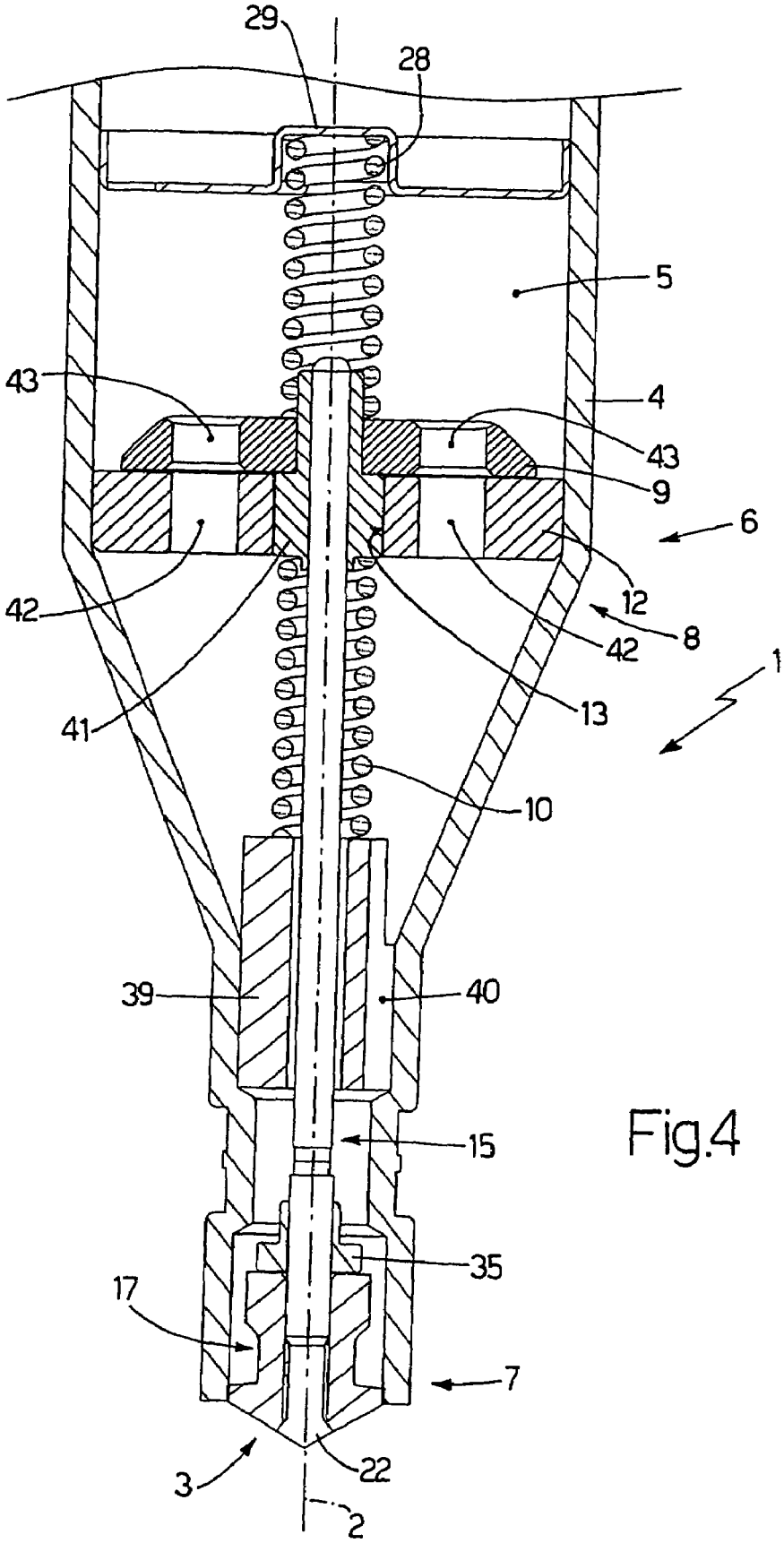
FIG. 4 shows a schematic lateral section, with parts removed for clarity, of a further embodiment of a fuel injector in accordance with the present invention.

FIG. 4 shows an alternative embodiment of injector 1, which differs from injector 1 in FIG. 1 substantially as regards the design and size of electromagnet 8, which is housed entirely inside supporting body 4 and is a so-called "multipole stator" type. More specifically, fixed magnetic armature 12 of electromagnet 8 houses two electrically independent coils 11 (not shown in detail). The main advantage of using a "multipole stator" type electromagnet 8 lies in the extremely high speed of electromagnet 8, which has a very small mass of magnetic material and, therefore, very little magnetic and mechanical inertia.

A tubular supporting member 39 is inserted in a fixed position inside feed channel 5 of supporting body 4 to form a support for main spring 10. Supporting member 39 houses a portion of pin 15 with a certain amount of transverse clearance, to permit free longitudinal slide of pin 15, and comprises a number of through holes or recesses 40 (only one shown in FIG. 4) to permit fuel flow to injection nozzle 3.

Fixed armature 12 comprises a central hole 13 engaged in sliding manner by a connecting bush 41 welded integrally to both pin 15 and movable armature 9 to connect pin 15 and movable armature 9 rigidly; and a number of peripheral through holes 42 (only two shown in FIG. 4) to permit fuel flow to injection nozzle 3. Main spring 10 is compressed between supporting member 39 and connecting bush 41, to keep pin 15 in the closed position with a given force.

Movable armature 9 of electromagnet 8 is annular, is smaller in diameter than the inside diameter of the corresponding portion of feed channel 5 of supporting body 4, and therefore cannot also act as a top guide for pin 15. In the FIG. 4 embodiment, the pin is guided at the top by connecting bush 41, which slides longitudinally, with substantially no transverse clearance, along central hole 13 of fixed armature 12.

Movable armature 9, as stated, is annular and smaller in diameter than the inside diameter of the corresponding portion of feed channel 5 of supporting body 4, and comprises a number of peripheral through holes 43 (only two shown in FIG. 4), each for permitting fuel flow to injection nozzle 3, and each coaxial with a corresponding peripheral hole 42 of fixed armature 12.

Injector 1 as described above has numerous advantages: it is cheap and easy to produce; provides for precise fuel flow calibration; and, above all, provides for highly precise, highly stable fuel injection flow, by being only marginally affected by thermal expansion.

The invention claimed is:

1. A fuel injector comprising:

an injection valve having an injection nozzle and a pin, the pin being movable to regulate fuel flow through the injection valve, wherein the pin terminates with a shutter head that engages a valve seat of the injection valve;

an electromagnetic actuator for moving the pin between a closed position and an open position respectively closing and opening the injection valve, the electromagnetic actuator having a main spring exerting a force for keeping the pin in the closed position, at least one coil, at least one fixed magnetic armature, and at least one movable armature, wherein the at least one movable armature is attracted magnetically by the at least one fixed magnetic armature in opposition to the force of the main spring and is connected mechanically to the pin;

a tubular supporting body having a feed channel housing the pin; and a sealing body, in which the valve seat of the injection valve is defined, and which seals the bottom of the feed channel;

wherein the pin comprises a stop member, which is integral with the pin and comes to rest on a top surface of the sealing body when the pin is in the open position opening the injection valve so as to limit a travel of the pin, wherein the at least one movable armature and the at least one fixed magnetic armature define an air gap therebetween between that has an axial size that is always greater than the travel of the pin to ensure the travel is determined by the stop member contacting a guide member and not by the at least one movable armature contacting the at least one fixed magnetic armature and, wherein the main spring has one end that rests on the at least one movable armature; and a calibrating spring having one end resting on the at least one movable armature, on the opposite side to the main spring.

2. An injector as claimed in claim 1, wherein the at least one movable armature comprises an annular member and a disk-shaped member, wherein the disk-shaped member closes a top of the annular member and comprises a central through hole for receiving a top portion of the pin, and wherein the disk-shaped member comprises a number of peripheral through holes permitting fuel flow to the injection nozzle.

3. An injector as claimed in claim 1, wherein the calibrating spring is compressed between the at least one movable armature and a retaining body inserted in a fixed position inside the tubular supporting body and wherein the position of the retaining body is adjustable at assembly to adjust an elastic force produced by the calibrating spring and so calibrate a total elastic thrust exerted on the at least one movable armature.

4. An injector as claimed in claim 3, wherein the retaining body comprises at least one through hole to permit fuel flow to the injection nozzle and a filtering element fitted to the through hole.

5. An injector as claimed in claim 4, wherein the retaining body is circular, and comprises a central portion, in which a seat for housing the calibrating spring is defined; and a peripheral portion, in which a number of through holes are formed to permit fuel flow to the injection nozzle.

6. An injector as claimed in claim 5, wherein each through hole of the number of through holes is fitted with a filtering element for retaining any residue or impurities in the fuel.

7. An injector as claimed in claim 1, wherein the shutter head is truncated-cone-shaped, is located outside the sealing body, and, in the closed position, is pushed against the sealing body in the opposite direction to a fuel feed direction; and the valve seat is truncated-cone-shaped to negatively reproduce the truncated-cone shape of the shutter head, so that, in the open position opening the injection valve, the shutter head is detached from the valve seat and forms an annular-section, truncated-cone-shaped fuel flow opening to impart a hollow conical shape to the injected fuel.

8. An injector as claimed in claim 7, wherein the sealing body comprises a bottom end portion, outside the tubular supporting body, that is truncated-cone-shaped; and wherein the shutter head comprises a bottom end portion, outside the tubular supporting body, that is conical, with its lateral surface sloping at an angle equal to a slope angle of a lateral surface of the bottom end portion of the sealing body.

9. An injector as claimed in claim 8, wherein the slope angle of the lateral surfaces of the bottom end portions is complementary with a flare angle of the shutter head.

10. An injector as claimed in claim 1, wherein the sealing body comprises a disk-shaped plugging member, which seals the bottom of the feed channel; and a tubular guide member extending upwards from the disk-shaped plugging member and housing the pin; and the stop member of the pin comes to rest on a top surface of the guide member, when the pin is in the open position opening the injection valve.

11. An injector as claimed in claim 10, wherein the guide member has, at least partly, an outside diameter smaller than an inside diameter of the feed channel, so as to define an outer channel for the fuel; and a number of through holes, which come out towards the valve seat, are formed in a bottom of the guide member.

12. An injector as claimed in claim 11, wherein the number of through holes in the guide member form a 60° to 80° angle with a longitudinal axis of the injector.

13. An injector as claimed in claim 11, wherein the number of through holes form a 90° angle with a longitudinal axis of the injector.

14. An injector as claimed in claim 11, wherein the number of through holes are offset with respect to a longitudinal axis of the injector, so as not to converge towards the longitudinal axis, and so as to produce swirl in the respective fuel streams in use.

15. An injector as claimed in claim 1, wherein the guide member defines a bottom guide for the pin.

16. An injector as claimed in claim 1, wherein the pin comprises a top portion integral with the at least one movable armature of the electromagnetic actuator; and a bottom portion supporting the shutter head and welded to the top portion.

17. An injector as claimed in claim 1, wherein the at least one fixed magnetic armature comprises a central hole engaged in sliding manner by a connecting bush, which supports one end of the main spring and is integral with both the pin and the at least one movable armature to connect the pin and the at least one movable armature rigidly.

18. An injector as claimed in claim 17, wherein the electromagnetic actuator is a multipole stator actuator, and the at least one fixed magnetic armature houses two electrically independent coils.

19. An injector as claimed in claim 18, wherein the at least one movable armature is annular, and is smaller in diameter than an inside diameter of the corresponding portion of the feed channel of the tubular supporting body.

20. An injector as claimed in claim 17, wherein the tubular supporting member houses a portion of the pin in sliding manner, and wherein the main spring is compressed between the tubular supporting member and the connecting bush to keep the pin in the closed position with a given force.

21. An injector as claimed in claim 17, wherein the at least one fixed magnetic armature comprises a number of peripheral through holes to permit fuel flow to the injection nozzle, and wherein the at least one movable armature comprises a number of peripheral through holes, each permitting fuel flow to the injection nozzle, and each coaxial with a corresponding peripheral through hole of the at least one fixed magnetic armature.

* * * * *